US007947095B2

(12) United States Patent
Palonen et al.

(10) Patent No.: US 7,947,095 B2
(45) Date of Patent: May 24, 2011

(54) METHOD OF AND AN APPARATUS FOR GASIFYING CARBONACEOUS MATERIAL

(75) Inventors: Juha Palonen, Varkaus (FI); Jorma Nieminen, Varkaus (FI); Katriina Nieminen, legal representative, Varkaus (FI)

(73) Assignee: Foster Wheeler Energia Oy, Espoo (FI)

( * ) Notice: Subject to any disclaimer, the term of this patent is extended or adjusted under 35 U.S.C. 154(b) by 198 days.

(21) Appl. No.: 11/914,622

(22) PCT Filed: May 15, 2006

(86) PCT No.: PCT/FI2006/050193

§ 371 (c)(1),
(2), (4) Date: May 9, 2008

(87) PCT Pub. No.: WO2006/123018

PCT Pub. Date: Nov. 23, 2006

(65) Prior Publication Data

US 2008/0250714 A1 Oct. 16, 2008

(30) Foreign Application Priority Data

May 18, 2005 (FI) ..... 20055237

(51) Int. Cl.

| | |
|---|---|
| ***C01B 3/36*** | (2006.01) |
| ***C01B 3/02*** | (2006.01) |
| ***C10J 3/46*** | (2006.01) |
| ***C10J 3/54*** | (2006.01) |
| ***C10J 3/68*** | (2006.01) |
| ***C10J 3/00*** | (2006.01) |
| ***B01J 7/00*** | (2006.01) |
| ***C10K 3/06*** | (2006.01) |

(52) U.S. Cl. ..... 48/197 R; 48/61; 48/202; 48/210; 423/648.1

(58) Field of Classification Search ..... 48/61, 197 R, 48/202, 210; 423/648.1
See application file for complete search history.

(56) References Cited

U.S. PATENT DOCUMENTS 3,454,383 A 7/1969 Pirsh et al. ..... 48/101
(Continued)

FOREIGN PATENT DOCUMENTS

EP 1 284 389 A1 2/2003
(Continued)

OTHER PUBLICATIONS

International Search Report dated Aug. 14, 2006, which was mailed in a Communication dated Aug. 22, 2006, and which issued in corresponding International Application No. PCT/FI2006/050193.

(Continued)

*Primary Examiner* — Alexa D Neckel
*Assistant Examiner* — Matthew J Merkling
(74) *Attorney, Agent, or Firm* — Fitzpatrick, Cella, Harper & Scinto

(57) ABSTRACT

A method of and an apparatus for gasifying carbonaceous material, the apparatus including a gasification reactor, to which oxygen-containing primary gas and secondary gasification gas are introduced, whereby a portion of the material to be gasified is gasified to product gas, residual carbon contained in the fly ash extracted from the product gas is combusted in a cyclone combustor, and the exhaust gas from the cyclone combustor is guided to above the bottom level of the gasification reactor to act as secondary gasification gas.

13 Claims, 2 Drawing Sheets

U.S. PATENT DOCUMENTS

| | | | | |
|---|---|---|---|---|
| 4,347,064 | A | 8/1982 | Reh et al. | 48/197 R |
| 2001/0011438 | A1 | 8/2001 | Fujimura et al. | 48/197 R |
| 2001/0016275 | A1* | 8/2001 | Takamura | 429/20 |
| 2002/0112403 | A1 | 8/2002 | Pope et al. | 48/127.3 |
| 2002/0159929 | A1* | 10/2002 | Kaneko et al. | 422/190 |
| 2004/0120874 | A1* | 6/2004 | Zauderer | 423/242.1 |

FOREIGN PATENT DOCUMENTS

| | | | |
|---|---|---|---|
| EP | 1 312 662 | A2 | 5/2003 |
| EP | 1 347 236 | A1 | 9/2003 |
| FI | 110266 | B | 12/2002 |
| GB | 1 473 395 | | 5/1977 |
| WO | WO 98/27182 | | 6/1998 |
| WO | WO 00/43468 | | 7/2000 |
| WO | WO 2005/052094 | A2 | 6/2005 |
| WO | WO 2006/123018 | A1 | 11/2006 |

OTHER PUBLICATIONS

Written Opinion of the International Searching Authority mailed Nov. 22, 2006, issued in International Application No. PCT/FI2006/050193.

Finnish Office Action dated Apr. 10, 2006, issued in related Finnish patent application No. 20055237.

* cited by examiner

METHOD OF AND AN APPARATUS FOR GASIFYING CARBONACEOUS MATERIAL

FIELD OF THE INVENTION

The present invention relates to a method of and an apparatus for efficiently gasifying carbonaceous material by minimizing the residual carbon content of the ash to be discharged.

The invention especially relates to a method, in which carbonaceous material is gasified to product gas in a gasification reactor, product gas and fly ash containing residual carbon entrained with the product gas are discharged from the gasification reactor to a product gas channel, fly ash is discharged from the product gas by a particle separator, and residual carbon contained in the separated ash is combusted in the cyclone combustor. The invention also relates to an apparatus for gasifying carbonaceous material, the apparatus comprising a gasification reactor, a product gas channel connected to the gasification reactor and a particle separator arranged in the product gas channel for separating fly ash containing residual carbon from the product gas, and a cyclone combustor for combusting the residual carbon contained in the fly ash.

BACKGROUND OF THE INVENTION

When gasifying carbonaceous fuels, for example, bio fuels or waste-derived fuels, a limited amount of air and/or oxygen and water vapor is generally introduced into a gasification reactor to generate product gas, the major components of which are carbon monoxide CO, hydrogen $H_2$, and hydrocarbons $C_xH_y$. The product gas being discharged from the gasification reactor may transfer with it ash particles and residual carbon, which must be separated by a particle separator, for example, by a filter, before the product gas is further utilized. The aim is to optimize the efficiency of the gasification system by maximizing the carbon conversion of the fuel, in other words, the residual carbon content of the ash to be discharged from the apparatus will be as low as possible.

U.S. Pat. No. 4,347,064 discloses an apparatus, in which the particles separated from the product gas of a first fluidized bed gasifier are conducted to a second fluidized bed gasifier, in which residual carbon contained in the ash is gasified and a portion of the generated product gas is conducted back to the first fluidized bed gasifier. Finnish Patent No. 110266 discloses a method, in which residual carbon contained in the ash, which is separated from the product gas of a fluidized bed gasifier is combusted in a fluidized bed combustion plant, and the generated oxygen-containing flue gas is conducted to act as secondary gasification gas of the fluidized bed gasifier.

U.S. Pat. No. 3,454,383 discloses a method, in which residual carbon separated by a particle separator from the product gas is combusted together with fine fuel coal in a cyclone combustor with theoretical to slightly excess air, whereby coal combusts completely and melt slag and very hot carbon dioxide-containing exhaust gas are generated. The hot exhaust gas is conducted through a narrow throat at the bottom of the gasification reactor to a widening lower portion of the reactor, where it fluidizes the coarse carbon particles introduced into the lower portion, layered according to the particle size. Thereby, the carbon gasifies gradually, and the smallest particles flow with the product gas to the product gas channel connected to the upper portion of the reactor. The difficulty with the method disclosed in the patent is that the high temperatures prevailing at the lower portion of the reactor easily lead to agglomeration of the fuel, especially, when gasifying bio fuels (e.g., wood, straw, agro fuels, etc.), or waste-derived fuels.

SUMMARY OF THE INVENTION

An object of the present invention is to provide an efficient and a reliable method of and an apparatus for gasifying carbonaceous material.

The object of the invention is especially to provide a simple method and apparatus, by means of which the carbon conversion of the fuel can be improved.

To overcome the problems of the prior art, a method is disclosed, the characterizing features of which are recited in the independent method claim. Thus, it is a characterizing feature of the method in accordance with the present invention that exhaust gas from a cyclone combustor is introduced into a gasification reactor above the bottom portion thereof to act as secondary gasification gas.

To overcome the problems of the prior art, an apparatus is also disclosed, the characterizing features of which are recited in the independent apparatus claim. Thus, it is a characterizing feature of the apparatus in accordance with the present invention that it comprises a channel for conducting the exhaust gas from the cyclone combustor to above the bottom level of a gasification reactor to act as a secondary gasification gas.

According to a preferred embodiment of the invention, the gasification reactor is a fluidized bed gasifier, but it may also be of some other gasifier type. The gasifier may operate substantially at an atmospheric pressure or it may be a pressurized gasifier arranged inside a pressure vessel. A fluidized bed gasifier in accordance with the invention is preferably a circulating fluidized bed gasifier, but it may also be a slow fluidized bed gasifier, i.e., a bubble bed gasifier. The invention is especially applicable for gasification of bio fuels and waste-derived fuels, but it may also be used for gasifying coal and other carbonaceous fuels. A gasifier in accordance with the invention may operate, for example, at the temperature of 400-1100° C. According to a preferred embodiment, the gasifier operates at a temperature of about 600-1000° C. and according to a most preferred embodiment, at a temperature of about 800-950° C.

Fly ash containing residual carbon, which has been entrained with the product gas formed in the gasification reactor is separated by a particle separator. The particle separator is preferably a filter, for example, a bag filter, but the particle separator may also be of some other type, for example, a metal or ceramic filter or a centrifugal separator. In order to remove harmful gaseous material, for example, heavy metals and alkali metals contained in the hot product gas by a particle separator, it is advantageous to cool the product gas prior to separating the particles. Generally, the product gas tends to be cooled by a gas cooler arranged in the product gas channel to such a low temperature that the harmful substances condense to the surface of the particles entrained with the product gas, for example, to a temperature of about 400-450° C.

The residual carbon content in the fly ash of a fluidized bed gasifier is, for example, depending on the used amount of the additives of at least 5%, typically it is 20-30%, but it may in come cases be even 50-60%. According to the present invention, the residual carbon contained in the fly ash separated by a particle separator is combusted in a cyclone combustor, whereby the residual carbon content of the ash can be reduced below 5%, preferably, below 3% and most preferably, below 1%.

A cyclone combustor is, for example, compared with a separate fluidized bed reactor, an inexpensive and simple solution for combusting residual carbon of the fly ash. Cyclone combustors are normally used with so-called slagging boilers, for example, for coal combustion at such a high temperature, that ash melts and it is removed in a melt state. Cyclone combustors can be constructed both horizontally and vertically. The particulate material to be combusted, and the combustion air, are introduced to a cyclone combustor tangentially at a very high velocity. The rotational movement and the differences in the velocity create an efficient mixing and complete combustion of the fuel even at a small air coefficient. The melt slag from the cyclone combustor flows to the extinguishing vessel of ash and very hot flue gas is discharged for cooling.

According to the present invention, residual carbon of the fly ash is combusted in a cyclone combustor, whereby at least a stoichiometric amount of air is introduced into the combustor. Preferably, air is introduced into the cyclone combustor in the amount of at least 1.5 times the stoichiometric amount, whereby the oxygen content of the exhaust gas to be introduced into the gasification reactor from the cyclone combustor is about 7%. According to the invention, the oxygen-containing exhaust gas from the cyclone combustor is introduced into the gasification reactor to act as secondary gasification gas. Most preferably, at least two times the stoichiometric amount of air is introduced into the cyclone combustor, whereby the oxygen-content of the exhaust gas to be introduced from the cyclone combustor into the gasification reactor is about 10%. Preferably, the amount of air to be introduced into the cyclone combustor is the greater, the greater the residual carbon content of the fly ash. Especially, when the residual carbon content of the fly ash is at least 50%, the amount of air to be introduced into the cyclone combustor is, preferably, at least three times the stoichiometric amount of air, whereby the oxygen content of the gas to be discharged from the cyclone combustor is about 14%.

The excess air to be introduced into the cyclone combustor, the temperature of which is generally 50-300° C., cools down the cyclone combustor and, thus, prevents the temperature thereof from rising too high. Preferably, the temperature of the cyclone combustor is maintained to be so low such that harmful material contained in the fly ash discharged from the gasification reactor is prevented from evaporating and thus, from returning with the exhaust gas to the gasification reactor.

The fuel of the gasification reactor may be, for example, waste-derived fuel, whereby the fly ash generated when gasifying the fuel may contain considerable amounts of chlorine compounds, such as sodium-, potassium- and copper-chlorides, the evaporation temperatures of which are about 1465-1500° C. In order to prevent the evaporation of these compounds, the temperature of the cyclone combustor must preferably be below 1456° C. Correspondingly, if the fly ash contains harmful amounts of, for example, lead chloride, the evaporation temperature of which is 950° C., the temperature of the cyclone combustor must preferably be less than 950° C. The temperature of the cyclone combustor can preferably be controlled not only by adjusting the amount of excess air, but also by heat exchange tubes arranged to the walls of the cyclone combustor.

The cyclone combustor may be a so-called slagging combustor, whereby the temperature thereof is typically more than 1000° C., and ash is discharged from the combustor as melt, or a so-called dry combustor, in which the temperature is, at most, approximately 950° C. and the ash remains in a solid state. The dry combustor is due to its low temperature more advantageous than the slagging combustor, because more of the harmful material of the fly ash, for example, chlorine compounds, eutectic mixtures and heavy metals are prevented by it from evaporating and returning to the gasification reactor.

An advantage resulting from the high temperature of the melt combustor is a high carbon conversion and getting the ash to a generally inert state as a result of melting and solidification, which facilitates the end storage thereof, but also in a dry combustor, the residual coal can be combusted very efficiently by using a great amount of excess air. Especially when using a slagging combustor, the exhaust gas channel of the cyclone combustor can preferably be arranged to perform gas cooling and filtering, for example, by a metal filter, or a so-called light ceramic filter, whereby the harmful material evaporated from the fly ash can be condensed and discharged from the apparatus. When the fly ash contains considerable amounts of harmful material evaporating at a relatively low temperature, it is advantageous to arrange cooling and filters of the exhaust gas also in the case of a dry combustor.

According to the invention, at least a portion of the hot oxygen-containing exhaust gas of the cyclone combustor is conducted to the gasification reactor to act as secondary gasification gas. The relatively high temperature of the exhaust gas promotes the endothermic reactions in the gasification reactor. In some cases, it is advantageous to bring all the secondary gasification gas into the gasification reactor through a cyclone combustor, but generally, it is more advantageous to bring one portion of the secondary gasification gas through the cyclone combustor and the other portion directly. According to a preferred embodiment, the amount of the secondary gasification gas brought through the cyclone combustor is adjusted in such a way that the temperature of the cyclone combustor remains within predefined limits, and the rest of the required secondary gasification gas is brought directly along a separate channel.

BRIEF DESCRIPTION OF THE DRAWINGS

The invention is discussed in more detail below with reference to the accompanying drawings, in which.

DETAILED DESCRIPTION OF THE PREFERRED EMBODIMENTS

Figure 1:
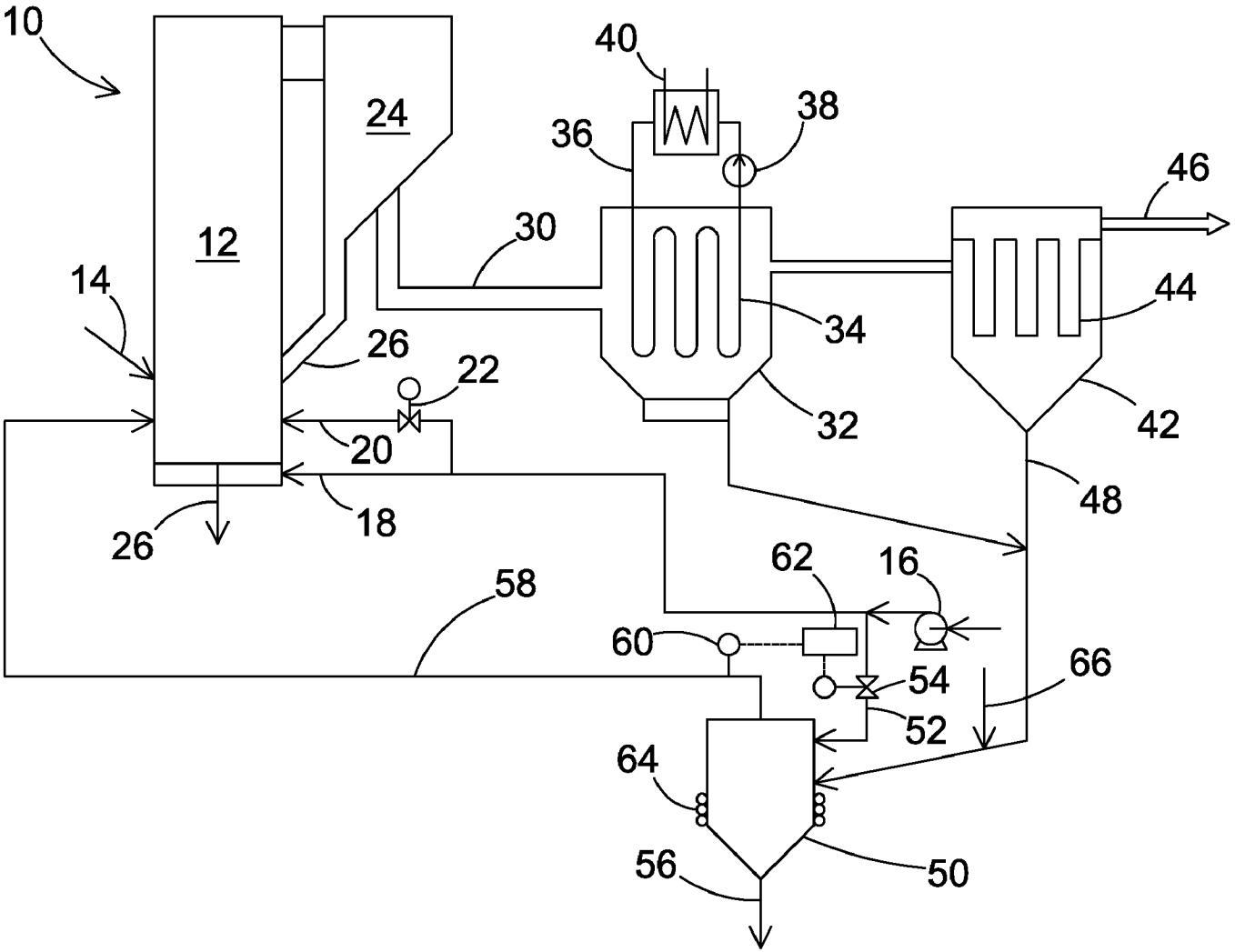
FIG. 1 schematically illustrates an apparatus in accordance with a first preferred embodiment of the present invention.

FIG. 1 illustrates a gasification system 10 in accordance with a preferred embodiment of the present invention, in which, in system 10, a gasification reactor 12 is disclosed as a circulating fluidized bed gasifier, but it may also be a reactor of some other type suitable for gasifying carbonaceous fuel. Supply means 14 are used for introducing material to be gasified, for example, waste-derived fuel or bio fuel, into the circulating fluidized bed reactor 12. When required, it is also possible to introduce inert bed material into the reactor 12, for example, sand, and material binding impurities, such as limestone.

Gasification gas, such as air, is pressurized by means of blower 16 to be introduced along a primary gasification gas channel 18 through a bottom grid to act as fluidization gas. A portion of the gasification gas may be introduced into the gasification reactor as a secondary gasification gas along a secondary gasification gas channel 20, which portion is adjustable by adjusting means, for example, by a control valve 22, generally 0.5-5 m above the bottom level of the gasification reactor. Solid particles are entrained with the fluidization gases and product gases generated in the reactor to the upper portion of the reactor 12, where a portion of the solid bed particles are discharged with the product gas to a particle separator 24. The majority of the solid material entrained with the product gas is separated from the product gas in the particle separator 24 and returned through a return duct 26 to the lower portion of the reactor 12.

In order to release the energy required by the endothermic gasification reactions from the fuel, such an amount of oxygen-containing gas, for example, air, is preferably introduced into the gasification reactor that partial combustion of the fuel takes place in the lower portion of the gasification reactor. In the partial combustion, a portion of the fuel oxidizes, forming carbon dioxide. In a fluidized bed gasifier, the gasification takes place typically at a temperature range of 600-1100° C., for example, at a temperature of 850° C. In the lower portion of the reactor 12, there are means 26, for example, an ash discharge channel, for the discharge of the material accumulating to the bottom of the reactor, so-called bottom ash.

The product gas exiting along a product gas channel 30 from the particle separator 22 still carries impurities, such as fine ash containing residual carbon and harmful gaseous material. Subsequent to the separator 22, the gas flow and the impurities with it are conducted to a gas cooler 32 arranged in a product gas channel 30. The gas cooler 32 may preferably comprise heat exchange tubes 34, in which a suitable medium, usually, water, is circulated via a circulation channel 36 by means of a pump 38. Heat energy is transferred by means of the medium from the product gas, for example, to an outside water cycle 40. The gas cooler 32 may also comprise a heat exchanger for heating, for example, the gasification gas entering the reactor 12 or reheating the product gas exiting the gasification system.

The product gas is conducted from the gas cooler 32 to a particle separator 42, for example, a bag filter, in which fine particles are removed from the product gas. The cleaned product gas is conducted from the particle filter 42 along a discharge channel 46 to combustion of the product gas or to some other further use, which may be, for example, further processing for a chemical process. The fly ash containing residual carbon separated in the particle filter 42 is transferred, possibly together with the fly ash gathered from the bottom of the gas cooler 32 along a fly ash channel 48 to a cyclone combustor 50.

An amount of pressurized oxygen-containing combustion gas, usually air, which amount is adjustable by a valve 54, is also supplied along channel 52 from the blower 16 to the cyclone combustor 50. In the embodiment disclosed in FIG. 1, the same blower 16 is also used for producing oxygen-containing gas to act as gasification gas in the gasification reactor 12, but alternatively, it is also possible to generate the combustion gas to the cyclone combustor 50 by a separate blower. The combustion gas is tangentially conducted at a high velocity to the cyclone combustor 50, where it generates a vortex, in which fly ash and combustion gas are efficiently mixed and the residual carbon of the fly ash combusts complete. The ash generated in the combustion and containing at most very little residual carbon is discharged from the lower portion of the cyclone combustor along the discharge channel 56, and the exhaust gas is conducted along the discharge channel 58 to the gasification reactor 12 to act as a secondary gasification gas.

The cyclone combustor 50 according to FIG. 1 is a so-called dry combustor, in which the temperature is maintained below the melting temperature of ash, and the ash can be discharged in a solid state. The temperature of the cyclone combustor is preferably adjusted by introducing a sufficient amount of excess air into the cyclone combustor, which cannot react with the carbon, but, due to its relatively low temperature, it cools down the cyclone combustor 50. The temperature control thereby takes place by adjusting the amount of excess air by adjusting means arranged in the combustion air channel 52 of the cyclone combustor, preferably, by means of a control valve 54.

By adjusting the temperature of the cyclone combustor, it is possible to prevent the evaporation of harmful substances in the fly ash, for example, chlorine compounds, and their recirculation along the discharge channel 58 into the gasification reactor 12. The temperature control may be preferably performed by measuring the temperature of the exhaust gas of the cyclone combustor by some suitable apparatus 60 for measuring temperature. Preferably, the apparatus comprises a control unit 62, by means of which the flow of combustion air is controlled, normally, by adjusting the control valve 54, on the basis of the temperature measured by the apparatus 60 for measuring the temperature of the exhaust gas.

The higher the residual carbon content of the fly ash is, the greater the capacity at which energy releases when the residual carbon releases in the cyclone combustor 50, and the greater the amount of the excess air must be so as to maintain the temperature of the combustor 50 within certain predefined limits. When the residual carbon content of the fly ash is 20%, according to one example, double the stoichiometric amount of air is required to maintain the temperature below 950° C. Correspondingly, when the residual carbon content of the fly ash is 50%, according to an example, triple the stoichiometric amount of air is required to maintain the same temperature.

When the amount of secondary gasification gas to be conducted along the exhaust gas channel 58 to the gasification reactor increases, the amount of secondary gasification gas to be conducted along the channel 20 must be decreased respectively. In some cases, cooling of the cyclone combustor may be advantageously increased by adjusting heat exchange surfaces 64 on the walls of the cyclone combustor, by means of which heat can be transferred to a heat exchange medium, for example, cooling water.

According to a preferred embodiment of the invention, getter material for binding harmful gases, for example, sand with a suitable particle size distribution, is introduced into the cyclone combustor 50 through a supply line 66. Thereby, harmful substances possibly releasing when combusting residual carbon of fly ash, for example, alkali metal salts, can react directly with the getter, and they will not recirculate to the gasification reactor 12, but they may be discharged through the discharge channel 56 to a suitable final placement site. The supply line 66 for the getter may advantageously be connected to the fly ash channel 48, to the combustion air channel 52 or directly to the cyclone combustor 50.

Figure 2:
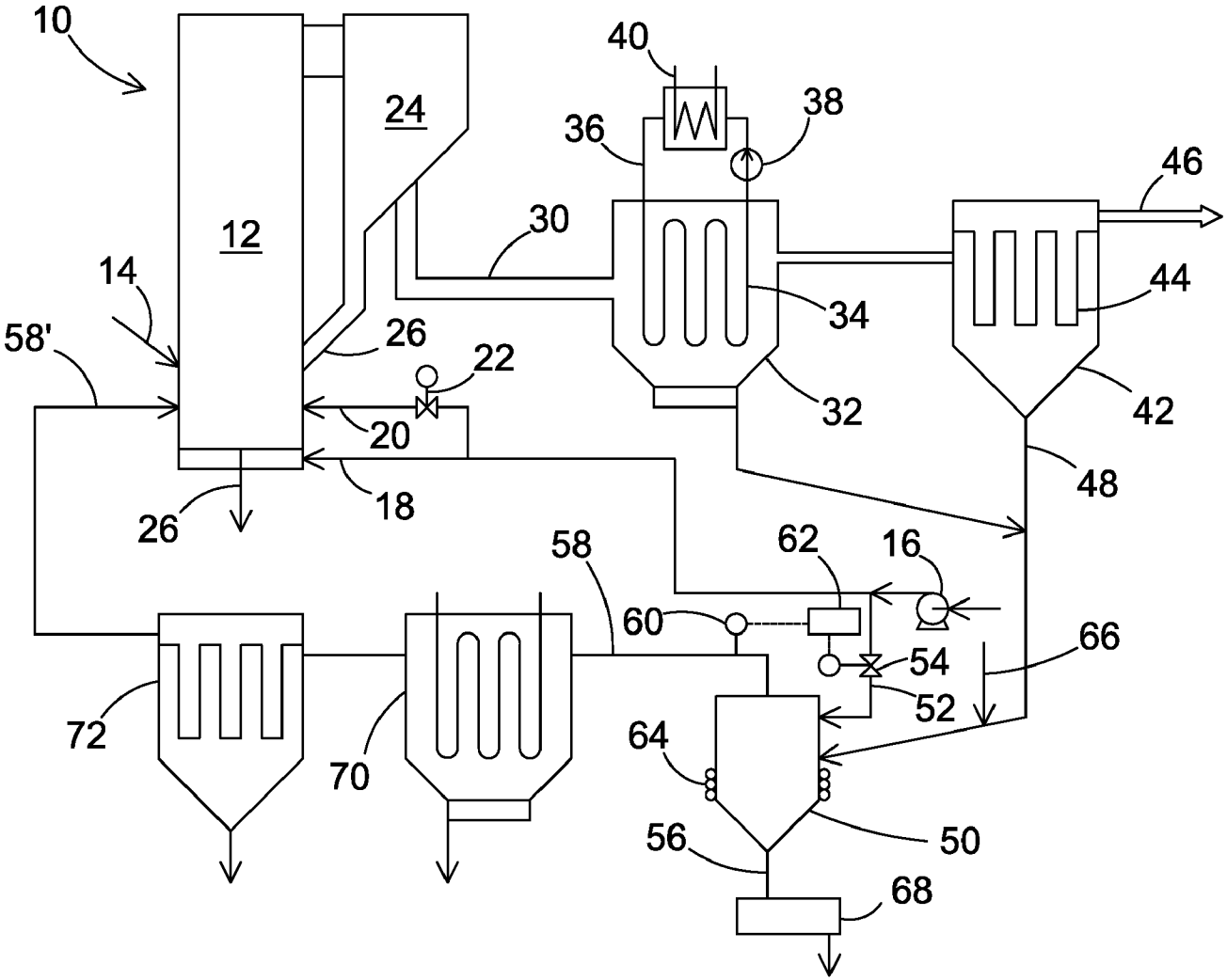
FIG. 2 schematically illustrates an apparatus in accordance with a second preferred embodiment of the present invention.

FIG. 2 discloses another advantageous embodiment of the present invention, which deviates from the embodiment in accordance with FIG. 1 in that the cyclone combustor 50 is a melt combustor, from the bottom of which melt slag is discharged along the discharge channel 56 to the extinguishing vessel 68. The temperature of the melt combustor may be preferably adjusted to the same methods that have previously been described to be for temperature control for a dry combustor, but the temperature to be adjusted is typically above 1000° C. According to a preferred embodiment, the temperature of the melt combustor is adjusted to be maintained below 1465° C., which is low enough to prevent the re-evaporation of a number of chlorine compounds.

Since significant amounts of harmful substances may escape at the temperature of the melt combustor from the cyclone combustor 50 along the exhaust gas channel 58 to the gas to be discharged, the exhaust gas of the cyclone combustor may be, according to a preferred embodiment, cooled down by a gas cooler 70, and the harmful substances condensing in the cooler may be discharged by a particle separator, for example, by a bag filter 72. The cleaned gas may be conducted from the filter 72 along an exhaust gas channel 58' to the gasification reactor 12 to act as secondary gasification gas.

If the fuel used in the gasification reactor is such that the fly ash separated from the product gas by the separator 44 contains a lot of harmful substances evaporating at a low temperature, it is possible to arrange, also in the exhaust channel 58 of a dry combustor 50 in accordance with FIG. 1, a gas cooler 70 and a particle separator 72, as illustrated in FIG. 2, for the discharge of harmful substances evaporated in the cyclone combustor.

While the invention has been herein described by way of examples in connection with what are at present considered to be the preferred embodiments, it is to be understood that the invention is not limited to the disclosed embodiments, but is intended to cover various combinations and/or modifications of its features and other applications within the scope of the invention as defined in the appended claims.

The invention claimed is:

1. A method of gasifying carbonaceous material, said method comprising the steps of:

(a) introducing carbonaceous material into a gasification reactor;

(b) introducing primary gasification gas into a bottom portion of the gasification reactor and secondary gasification gas above the bottom portion of the gasification reactor, and combusting the primary gasification gas, the secondary gasification gas and the carbonaceous material in the gasification reactor, whereby a portion of the carbonaceous material gasifies to product gas, and ash containing residual carbon is generated;

(c) discharging the product gas and fly ash containing residual carbon entrained therewith from the gasification reactor to a product gas channel connected to the gasification reactor;

(d) conducting the product gas and the fly ash containing residual carbon along the product gas channel to a particle separator, where fly ash containing residual carbon is separated from the product gas;

(e) introducing separated fly ash containing residual carbon and oxygen-containing gas into a cyclone combustor so as to combust the residual carbon, generating exhaust gas and ash, which are separately removed from the cyclone combustor;

(f) conducting a portion of the exhaust gas from the cyclone combustor to the gasification reactor and introducing the portion of the exhaust gas above the bottom portion of the gasification reactor, to act as the secondary gasification gas; and (g) adjusting the temperature of the cyclone combustor to remain below 950° C. and below the melting temperature of the ash, by adjusting in step (e) the rate of introduction of the oxygen-containing gas into the cyclone combustor to be in an amount of at least 1.5 times the stoichiometric amount.

2. A method in accordance with claim 1, further comprising measuring the temperature of the exhaust gas from the cyclone combustor and adjusting in step (e) the rate of introducing the oxygen-containing gas on the basis of the temperature of the exhaust gas.

3. A method in accordance with claim 1, further comprising introducing oxygen-containing gas into the cyclone combustor in step (e) on the basis of the content of residual carbon in the fly ash.

4. A method in accordance with claim 1, further comprising introducing oxygen containing gas into the cyclone combustor in step (e) in an amount of at least two times the stoichiometric amount.

5. A method in accordance with claim 4, further comprising introducing oxygen-containing gas into the cyclone combustor in step (e) in an amount of at least three times the stoichiometric amount.

6. A method in accordance with claim 1, further comprising removing heat from the cyclone combustor by heat exchange surfaces.

7. A method in accordance with claim 1, further comprising introducing getter material into the cyclone combustor for binding cooled harmful gases, which are released when combusting the residual carbon.

8. A method in accordance with claim 1, further comprising cooling the exhaust gas by a gas cooler and by separating particles from the exhaust gas prior to the introduction of the exhaust gas to the gasification reactor.

9. A method in accordance with claim 1, wherein the cyclone combustor comprises heat exchange surfaces for adjusting the temperature of the cyclone combustor.

10. A method in accordance with claim 1, wherein the cyclone combustor is provided with a supply line for introducing getter material to bind harmful gases.

11. A method in accordance with claim 1, further comprising cooling the exhaust gas of the cyclone combustor and separating particles from the cooled exhaust gas of the cyclone combustor.

12. A method in accordance with claim 1, wherein the gasification reactor is a fluidized bed gasifier.

13. A method in accordance with claim 1, wherein the gasification reactor is a circulating fluidized bed gasifier.

* * * * *